US009863256B2

(12) United States Patent
Lee et al.

(10) Patent No.: US 9,863,256 B2
(45) Date of Patent: Jan. 9, 2018

(54) INTERNAL COOLING SYSTEM WITH INSERT FORMING NEARWALL COOLING CHANNELS IN AN AFT COOLING CAVITY OF AN AIRFOIL USABLE IN A GAS TURBINE ENGINE

(71) Applicant: Siemens Aktiengesellschaft, München (DE)

(72) Inventors: Ching-Pang Lee, Cincinnati, OH (US); Jae Y. Um, Winter Garden, FL (US); Zhengxiang Pu, Oviedo, FL (US); Mohamed Abdullah, Cincinnati, OH (US); Eric Schroeder, Loveland, OH (US); Anthony Waywood, Cincinnati, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/505,218

(22) PCT Filed: Sep. 4, 2014

(86) PCT No.: PCT/US2014/053968
§ 371 (c)(1),
(2) Date: Feb. 20, 2017

(87) PCT Pub. No.: WO2016/036366
PCT Pub. Date: Mar. 10, 2016

(65) Prior Publication Data
US 2017/0268348 A1 Sep. 21, 2017

(51) Int. Cl.
*F01D 5/18* (2006.01)

(52) U.S. Cl.
CPC ..... *F01D 5/188* (2013.01); *F05D 2220/32* (2013.01); *F05D 2250/183* (2013.01); *F05D 2260/20* (2013.01)

(58) Field of Classification Search
CPC ..... F01D 5/187; F01D 5/188; F01D 5/189; F05D 2220/32; F05D 2250/183; F05D 2260/20
See application file for complete search history.

(56) References Cited

U.S. PATENT DOCUMENTS 3,846,041 A 11/1974 Albani
3,973,874 A 8/1976 Corsmeier et al.
(Continued)

FOREIGN PATENT DOCUMENTS

CN 85108282 A 8/1986
CN 86108817 A 7/1987
(Continued)

OTHER PUBLICATIONS

PCT International Search Report and Written Opinion dated May 28, 2015 corresponding to PCT Application PCT/US2014/053968 filed Sep. 4, 2014.

*Primary Examiner* — Igor Kershteyn

(57) ABSTRACT

An airfoil (10) for a gas turbine engine in which the airfoil (10) includes an internal cooling system (14) with one or more internal cavities having an insert (18) contained within an aft cooling cavity (76) to form nearwall cooling channels having enhanced flow patterns is disclosed. The flow of cooling fluids in the nearwall cooling channels may be controlled via a plurality of cooling fluid flow controllers (22) extending from the outer wall (24) forming the generally hollow elongated airfoil (26). The cooling fluid flow controllers (22) may be collected into spanwise extending rows. In at least one embodiment, the cooling fluid flow controllers (22) may be positioned within a pressure side
(Continued)

nearwall cooling channel (48) and a suction side nearwall cooling channel (50) that are both in fluid communication with a trailing edge channel (30). The trailing edge channel (30) may also include cooling fluid flow controllers (22) extending between the outer walls (12, 13) forming the pressure and suction sides.

12 Claims, 6 Drawing Sheets

(56) References Cited

U.S. PATENT DOCUMENTS

| | | | | |
|---|---|---|---|---|
| 4,257,734 | A | 3/1981 | Guy et al. | |
| 4,403,917 | A | 9/1983 | Laffitte et al. | |
| 5,027,604 | A | 7/1991 | Krueger | |
| 5,246,341 | A * | 9/1993 | Hall | F01D 5/187 416/97 R |
| 5,253,976 | A | 10/1993 | Cunha | |
| 5,533,864 | A | 7/1996 | Nomoto et al. | |
| 5,591,002 | A | 1/1997 | Cunha et al. | |
| 5,624,231 | A | 4/1997 | Ohtomo et al. | |
| 5,690,472 | A * | 11/1997 | Lee | F01D 5/187 416/95 |
| 5,704,763 | A * | 1/1998 | Lee | F01D 5/188 415/115 |
| 6,036,436 | A | 3/2000 | Fukuno et al. | |
| 6,183,194 | B1 | 2/2001 | Cunha et al. | |
| 6,439,846 | B1 | 8/2002 | Anderson et al. | |
| 7,753,650 | B1 * | 7/2010 | Liang | F01D 5/187 416/97 R |
| 8,052,378 | B2 * | 11/2011 | Draper | F01D 5/186 415/115 |
| 8,172,504 | B2 | 5/2012 | Flodman et al. | |
| 8,197,210 | B1 | 6/2012 | Liang | |
| 8,322,988 | B1 | 12/2012 | Downs et al. | |
| 8,348,613 | B2 | 1/2013 | Gregg et al. | |
| 8,403,631 | B2 | 3/2013 | Surace et al. | |
| 8,500,405 | B1 | 8/2013 | Jones et al. | |
| 2007/0110585 | A1 | 5/2007 | Bonnet | |
| 2010/0054915 | A1 | 3/2010 | Devore et al. | |
| 2010/0247284 | A1 * | 9/2010 | Gregg | F01D 5/189 415/1 |
| 2011/0107769 | A1 | 5/2011 | Stevenson et al. | |
| 2011/0123351 | A1 | 5/2011 | Hada et al. | |
| 2014/0110559 | A1 | 4/2014 | Lee et al. | |
| 2014/0112799 | A1 | 4/2014 | Lee et al. | |
| 2015/0159489 | A1 * | 6/2015 | Lee | F01D 5/187 416/97 R |
| 2015/0198050 | A1 * | 7/2015 | Lee | F01D 5/188 415/115 |

FOREIGN PATENT DOCUMENTS

| | | | |
|---|---|---|---|
| EP | 0541207 | A1 | 5/1993 |
| EP | 1091091 | A2 | 4/2001 |
| EP | 1188902 | A2 | 3/2002 |
| EP | 1221538 | A2 | 10/2002 |
| EP | 2107214 | A1 | 10/2009 |
| EP | 2233693 | A1 | 9/2010 |
| JP | S61187501 | A | 8/1986 |
| JP | S6380004 | A | 4/1988 |

* cited by examiner

INTERNAL COOLING SYSTEM WITH INSERT FORMING NEARWALL COOLING CHANNELS IN AN AFT COOLING CAVITY OF AN AIRFOIL USABLE IN A GAS TURBINE ENGINE

FIELD OF THE INVENTION

This invention is directed generally to gas turbine engines, and more particularly to internal cooling systems for airfoils in gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoils. The airfoils include internal cooling systems for reducing the temperature of the airfoils. Airfoils have had internal inserts forming nearwall cooling channels. However, most inserts are formed from plain sheet metal with a plurality of impingement holes therein to provide impingement cooling on the pressure and suction sides of the airfoil. The upstream post impingement air pass downstream impingement jets and forms cross flow before exiting through film holes. The cross flow can bend the impinging jets away from the impingement target surface and reduce the cooling effectiveness. To reduce the amount of cross flow, the post impingement air has been vented out through exterior film holes. However, the greater the number of film cooling holes, the less efficient usage of cooling air is. The impingement holes consume cooling air pressure and often pose a problem at the leading edge, where showerhead holes experience high stagnation gas pressure on the external surface. Thus, a need for a more efficient internal cooling system for gas turbine airfoils exists.

SUMMARY OF THE INVENTION

An airfoil for a gas turbine engine in which the airfoil includes an internal cooling system with one or more internal cavities having an insert contained therein that forms nearwall cooling channels having enhanced flow patterns is disclosed. The flow of cooling fluids in the nearwall cooling channels may be controlled via a plurality of cooling fluid flow controllers extending from the outer wall forming the generally hollow elongated airfoil. The cooling fluid flow controllers may be collected into spanwise extending rows. In at least one embodiment, the cooling fluid flow controllers may be positioned within a pressure side nearwall cooling channel and a suction side nearwall cooling channel that are both in fluid communication with a trailing edge channel. The trailing edge channel may also include cooling fluid flow controllers extending between the outer walls forming the pressure and suction sides, thereby increasing the effectiveness of the internal cooling system. The internal cooling system may include one or more bypass flow reducers extending from the insert toward the outer wall to direct the cooling fluids through the nearwall cooling channels created by the cooling fluid flow controllers, thereby increasing the effectiveness of the internal cooling system.

In at least one embodiment, a turbine airfoil for a gas turbine engine may include a generally elongated hollow airfoil formed from an outer wall, and may have a leading edge, a trailing edge, a pressure side, a suction side, and inner endwall at a first end and an outer endwall at a second end that is generally on an opposite side of the generally elongated hollow airfoil from the first end and a cooling system positioned within interior aspects of the generally elongated hollow airfoil. The cooling system may include one or more aft cooling cavities in which an insert is positioned that forms a pressure side nearwall cooling channel and a suction side nearwall cooling channel. A plurality of cooling fluid flow controllers may extend from the outer wall forming the generally elongated hollow airfoil toward the insert, where the cooling fluid flow controllers form a plurality of alternating zigzag channels extending downstream toward the trailing edge. One or more bypass flow reducers may extend from the insert toward the outer wall to reduce bypass flow of cooling fluids.

One or more of the cooling fluid flow controllers may have a cross-sectional area formed by a pressure side that is on an opposite side from a suction side, whereby the pressure and suction sides are coupled together via a leading edge and trailing edge on an opposite end of the at least one cooling fluid flow controller from the leading edge and wherein the pressure side has a generally concave curved surface and the suction side has a generally convex curved surface. The plurality of cooling fluid flow controllers may be collected into a first spanwise extending row of cooling fluid flow controllers, whereby each of the cooling fluid flow controllers within the first spanwise extending row of cooling fluid flow controllers may be positioned similarly, such that a pressure side of one cooling fluid flow controller is adjacent to a suction side of an adjacent cooling fluid flow controller, except for a cooling fluid flow controller at an end of the first spanwise extending row.

A second spanwise extending row of cooling fluid flow controllers may be positioned downstream from the first spanwise extending row of cooling fluid flow controllers. The second spanwise extending row of cooling fluid flow controllers may have one or more cooling fluid flow controllers with a pressure side on an opposite side of the cooling fluid flow controller than in the first spanwise extending row of cooling fluid flow controllers, thereby causing cooling fluid flowing through the second spanwise extending row of cooling fluid flow controllers to be directed downstream with a spanwise vector that is opposite to a spanwise vector imparted on the cooling fluid by the first spanwise extending row of cooling fluid flow controllers. As such, a zigzag flow pattern of the cooling fluids may be established within the cooling cavity.

Each of the cooling fluid flow controllers forming the second spanwise extending row of cooling fluid flow controllers may have one or more cooling fluid flow controllers with a pressure side on an opposite side of the cooling fluid flow controller than in the first spanwise extending row of cooling fluid flow controllers. In at least one embodiment, the plurality of cooling fluid flow controllers may extend from the outer wall forming the pressure side of the generally elongated hollow airfoil. In another embodiment, the plurality of cooling fluid flow controllers may extend from the outer wall forming the suction side of the generally elongated hollow airfoil.

The internal cooling system may include a trailing edge channel. In at least one embodiment, both the pressure side nearwall cooling channel and the suction side nearwall cooling channel may be in fluid communication with a trailing edge channel. The trailing edge channel may include a plurality of cooling fluid flow controllers extending from the outer wall forming the pressure side to the outer wall forming the suction side, wherein the cooling fluid flow controllers form a plurality of alternating zigzag channels. The plurality of cooling fluid flow controllers may be collected into a first spanwise extending row of cooling fluid flow controllers, wherein each of the cooling fluid flow controllers within the first spanwise extending row of cooling fluid flow controllers is positioned similarly, such that a pressure side of one cooling fluid flow controller is adjacent to a suction side of an adjacent cooling fluid flow controller, except for a cooling fluid flow controller at an end of the first spanwise extending row. A second spanwise extending row of cooling fluid flow controllers may be positioned downstream from the first spanwise extending row of cooling fluid flow controllers, wherein the second spanwise extending row of cooling fluid flow controllers has at least one cooling fluid flow controller with a pressure side on an opposite side of the cooling fluid flow controller than in the first spanwise extending row of cooling fluid flow controllers, thereby causing cooling fluid flowing through the second spanwise extending row of cooling fluid flow controllers to be directed downstream with a spanwise vector that is opposite to a spanwise vector imparted on the cooling fluid by the first spanwise extending row of cooling fluid flow controllers.

The insert may include one or more refresher holes to supply the trailing edge channel in addition to the pressure side nearwall cooling channel and the suction side nearwall cooling channel. The insert in the aft cooling cavity may include one or more inlets in fluid communication with a cooling fluid supply positioned in an inner diameter of the generally elongated hollow airfoil.

An advantage of the internal cooling system is that the cooling fluid flow controllers significantly increase the exposed surface area within the cooling system for better cooling system performance.

Another advantage of the internal cooling system is that the insert having the bypass flow reducers directs cooling fluids towards the outer wall to increase cooling rather than using a higher number of impingement holes in the insert, which would only increase the problems associated with cross flow.

Yet another advantage of the internal cooling system is that the bypass flow reducers effectively force more high speed cooling air into the zigzag flow channels formed by the multiple rows of cooling fluids flow controllers adjacent to the hot exterior walls of the airfoil.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
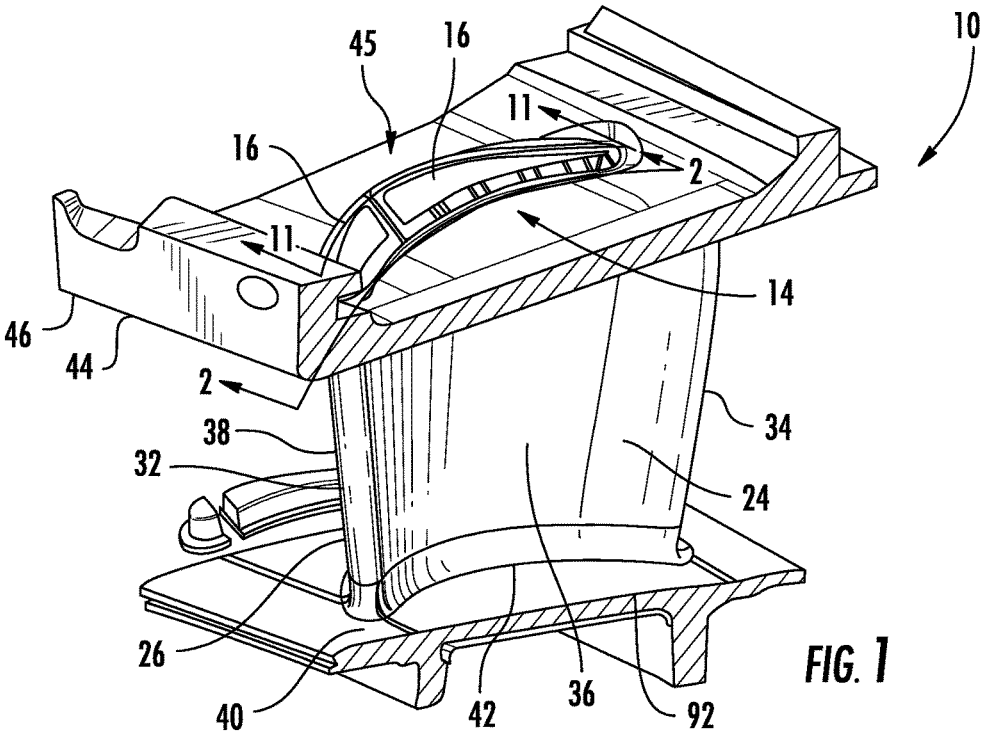
FIG. 1 is a perspective view of a turbine airfoil including the internal cooling system.

As shown in FIGS. 1-12, an airfoil 10 for a gas turbine engine in which the airfoil 10 includes an internal cooling system 14 with one or more internal cavities 16 having an insert 18 contained therein that forms nearwall cooling channels 20 having enhanced flow patterns is disclosed. The flow of cooling fluids in the nearwall cooling channels 20 may be controlled via a plurality of cooling fluid flow controllers 22 extending from the outer wall 24 forming the generally hollow elongated airfoil 26. The cooling fluid flow controllers 22 may be collected into spanwise extending rows 28. In at least one embodiment, the cooling fluid flow controllers 22 may be positioned within a pressure side nearwall cooling channel 48 and a suction side nearwall cooling channel 50 that are both in fluid communication with a trailing edge channel 30. The trailing edge channel 30 may also include cooling fluid flow controllers 22 extending between the outer walls 13, 12 forming the pressure and suction sides 36, 38, thereby increasing the effectiveness of the internal cooling system 14. The internal cooling system 14 may include one or more bypass flow reducers 31 extending from the insert 18 toward the outer wall 24 to direct the cooling fluids through the nearwall cooling channels 20 created by the cooling fluid flow controllers 22, thereby increasing the effectiveness of the internal cooling system 14.

Figure 3:
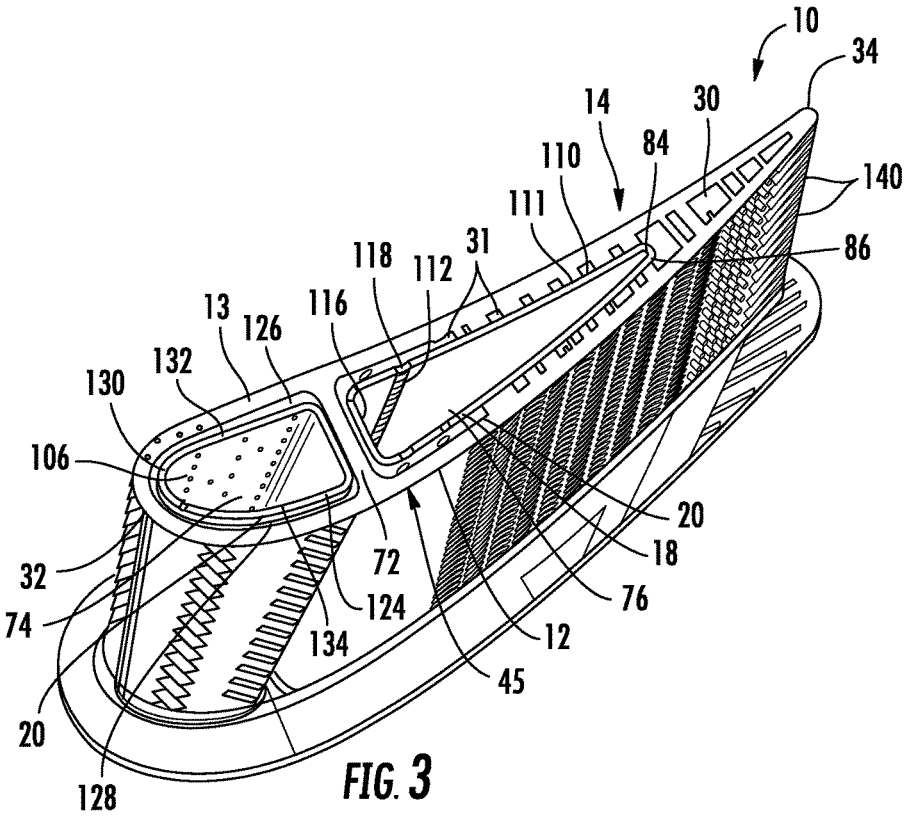
FIG. 3 is a cross-sectional, perspective view of the turbine airfoil taken along section line 3-3 in FIG. 2.
Figure 4:
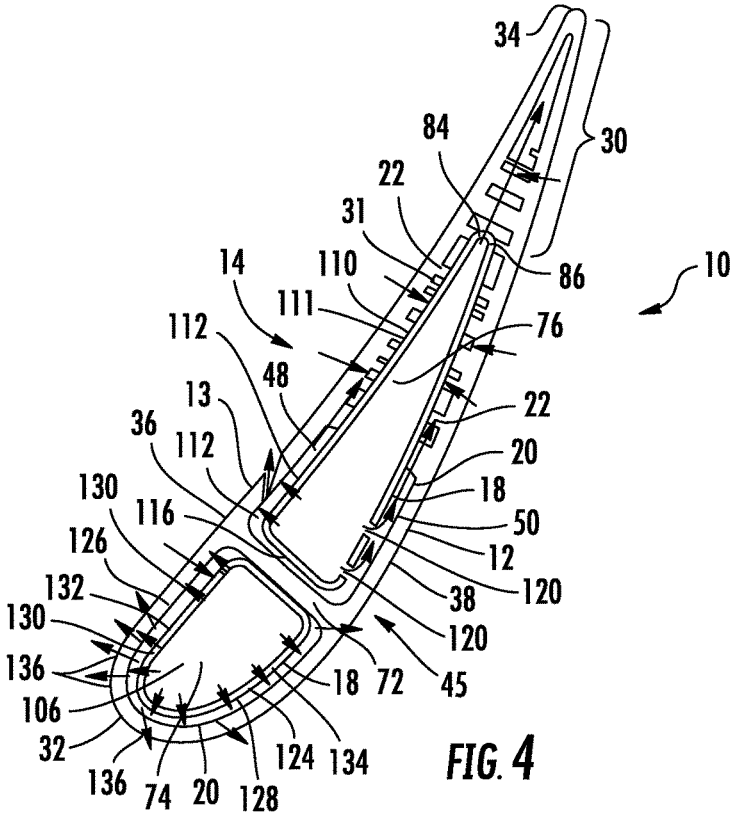
FIG. 4 is a cross-sectional view of the turbine airfoil taken along section line 3-3 in FIG. 2.
Figure 5:
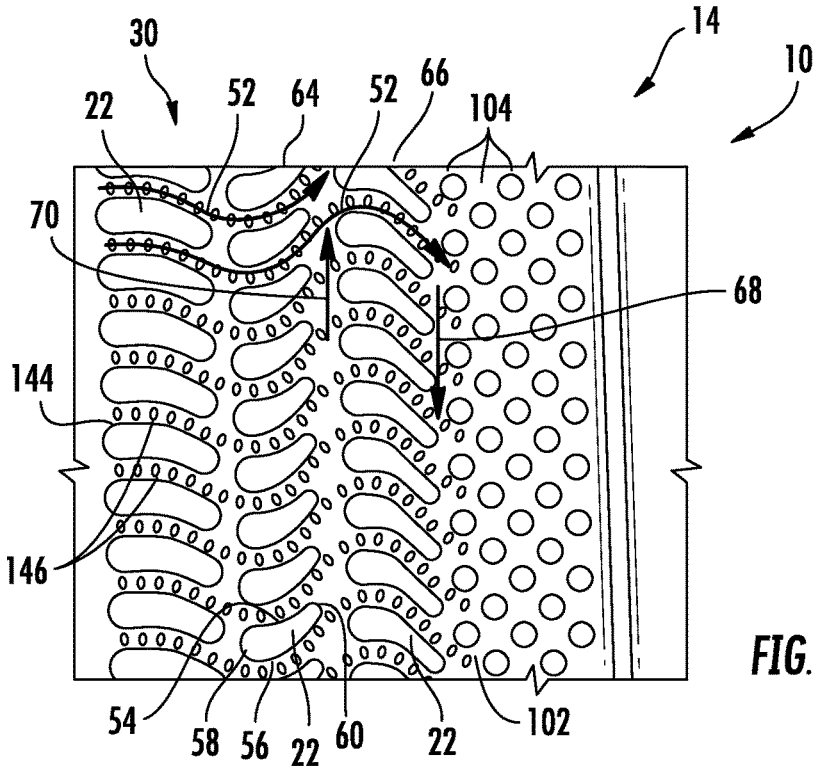
FIG. 5 is a detail view of components of the internal cooling system shown within the trailing edge channel taken at detail view 5 in FIG. 2.

In at least one embodiment, as shown in FIG. 1, the airfoil 10 may be a turbine airfoil 10 for a gas turbine engine and may include a generally elongated hollow airfoil 26 formed from an outer wall 24, and having a leading edge 32, a trailing edge 34, a pressure side 36, a suction side 38, and inner endwall 40 at a first end 42 and an outer endwall 44 at a second end 46 that is generally on an opposite side of the generally elongated hollow airfoil 26 from the first end 42 and a cooling system 14 positioned within interior aspects of the generally elongated hollow airfoil 26. As shown in FIGS. 3 and 4, the cooling system 14 may include one or more midchord cooling cavities 45. In at least one embodiment, the midchord cooling cavity 45 may include one or more ribs 72 separating the midchord cooling cavity 45 into a forward cooling cavity 74 and an aft cooling cavity 76 and forming an upstream end of the aft cooling cavity 76. The cooling system 14 may include one or more aft cooling cavities 76 in which an aft insert 18 may be positioned that forms a pressure side nearwall cooling channel 48 and a suction side nearwall cooling channel 50. A plurality of cooling fluid flow controllers 22, as shown in FIGS. 5, 6, 11 and 12, may extend from the outer wall 24 forming the generally elongated hollow airfoil 26 toward the aft insert 18. The cooling fluid flow controllers 22 may form a plurality of alternating zigzag channels 52 extending downstream toward the trailing edge 34, as shown in FIG. 5. The aft insert 18 may be positioned within the aft cooling cavity 76 such that a gap 110, as shown in FIGS. 3 and 4, exists between an end 111 of the cooling fluid flow controllers 22 and the aft insert 18. In at least one embodiment, the gap 110 may be less than about 0.8 millimeters. In another embodiment, the gap 110 may be about 0.3 millimeters.

In at least one embodiment, the internal cooling system 1, as shown in FIG. 4, the cooling fluid flow controllers 22 may form a plurality of alternating zigzag channels 52 extending in a generally chordwise direction downstream toward the trailing edge 34. The zigzag channels 52 may be formed from one or more cooling fluid flow controllers 22 having a cross-sectional area formed by a pressure side 54 that is on an opposite side from a suction side 56, whereby the pressure and suction sides 54, 56 may be coupled together via a leading edge 58 and trailing edge 60 on an opposite end of the cooling fluid flow controller 22 from the leading edge 58. The pressure side 54 may have a generally concave curved surface and the suction side 56 may have a generally convex curved surface. In at least one embodiment, the plurality of cooling fluid flow controllers 22 may extend from the outer wall 12 forming the pressure side 36 of the generally elongated hollow airfoil 26. Similarly, the plurality of cooling fluid flow controllers 22 may extend from the outer wall 13 forming the suction side 38 of the generally elongated hollow airfoil 26.

A plurality of cooling fluid flow controllers 22 may be collected into a first spanwise extending row 64 of cooling fluid flow controllers 22. One or more of the cooling fluid flow controllers 22 forming the first spanwise extending row 64 may have cross-sectional areas formed by a pressure side 54 that is on an opposite side from a suction side 56, whereby the pressure and suction sides 54, 56 are coupled together via a leading edge 58 and trailing edge 60 on an opposite end of the cooling fluid flow controller 22 from the leading edge 58. A pressure side 54 of one cooling fluid flow controller 22 may be adjacent to a suction side 56 of an adjacent cooling fluid flow controller 22. In at least one embodiment, each of the cooling fluid flow controllers 22 within the first spanwise extending row 64 of cooling fluid flow controllers 22 may be positioned similarly, such that a pressure side 54 of one cooling fluid flow controller 22 is adjacent to a suction side 56 of an adjacent cooling fluid flow controller 22, except for a cooling fluid flow controller 22 at an end of the first spanwise extending row 64 where there is no adjacent cooling fluid flow controller 22.

The internal cooling system 14 may also include a second spanwise extending row 66 of cooling fluid flow controllers 22 positioned downstream from the first spanwise extending row 64 of cooling fluid flow controllers 22. The second spanwise extending row 66 of cooling fluid flow controllers 22 may have one or more cooling fluid flow controllers 22 with a pressure side 54 on an opposite side of the cooling fluid flow controller 22 than in the first spanwise extending row of cooling fluid flow controllers 22, thereby causing cooling fluid flowing through the second spanwise extending row 66 of cooling fluid flow controllers 22 to be directed downstream with a spanwise vector 68 that is opposite to a spanwise vector 70 imparted on the cooling fluid by the first spanwise extending row 64 of cooling fluid flow controllers 22. In at least one embodiment, each of the cooling fluid flow controllers 22 forming the second spanwise extending row 28 of cooling fluid flow controllers 22 has a pressure side 54 on an opposite side of the cooling fluid flow controller 22 than in the first spanwise extending row 64 of cooling fluid flow controllers 22. The pressure side nearwall cooling channel 48 or the suction side nearwall cooling channel 50, or both, may include a repetitive pattern of first and second spanwise extending rows 94, 96 of cooling fluid flow controllers 22 to form alternating zigzag channels 52 extending generally chordwise towards the trailing edge 34.

Figure 6:
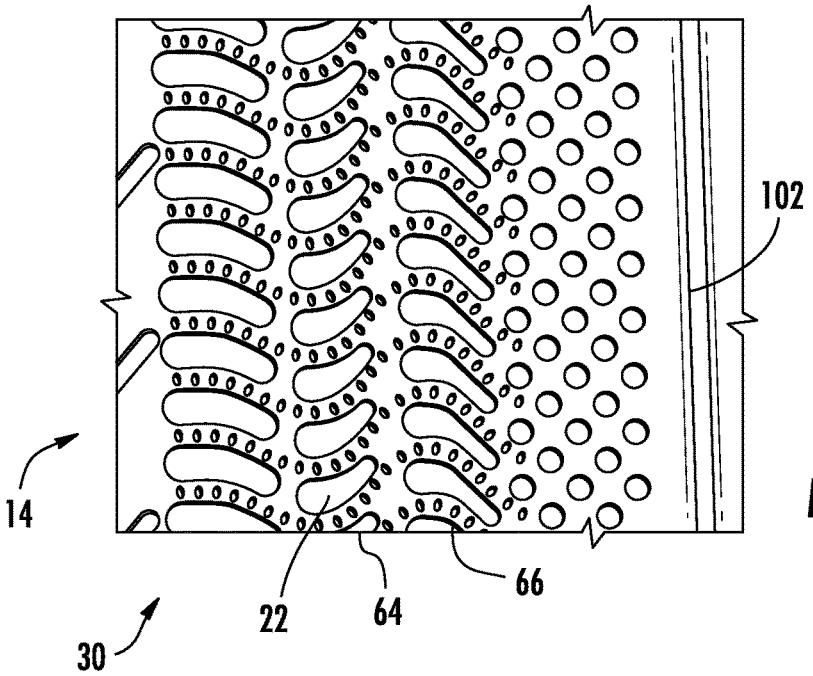
FIG. 6 is a detail view of the components of the internal cooling system shown within the trailing edge channel in FIG. 5.
Figure 7:
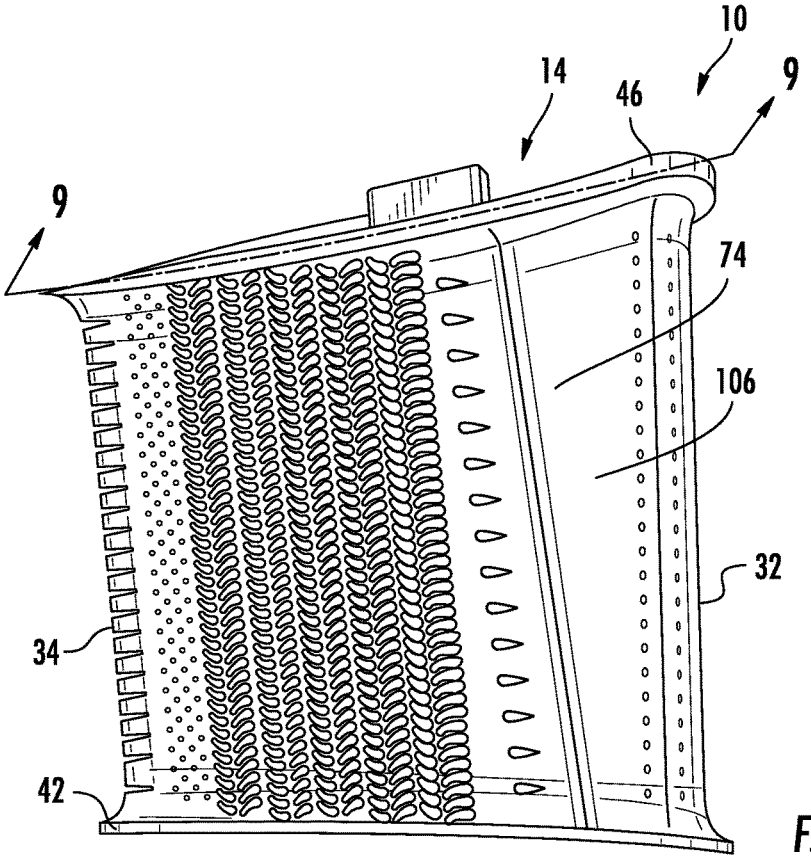
FIG. 7 is a pressure side view of the turbine airfoil including the internal cooling system.
Figure 8:
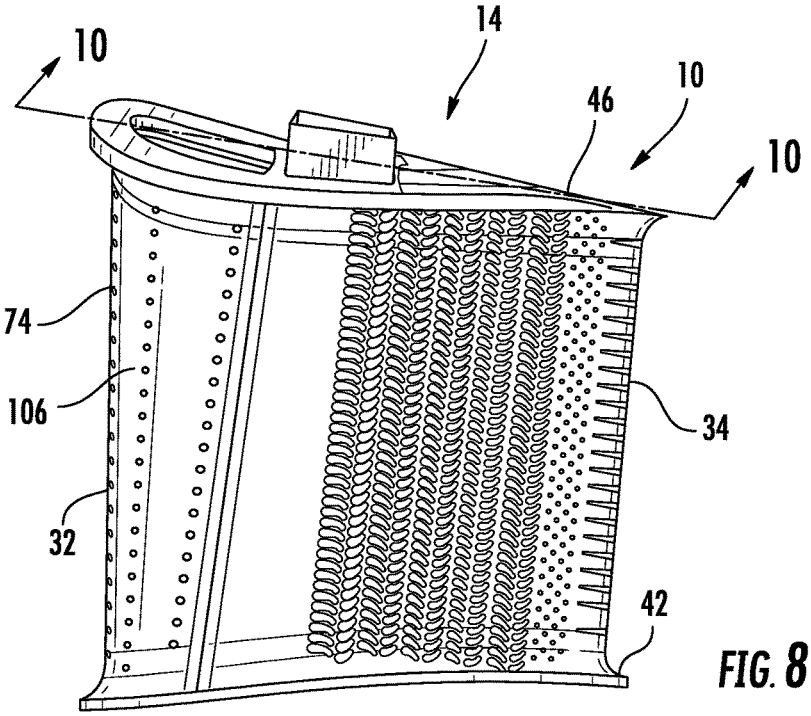
FIG. 8 is a suction side view of the turbine airfoil including the internal cooling system.
Figure 9:
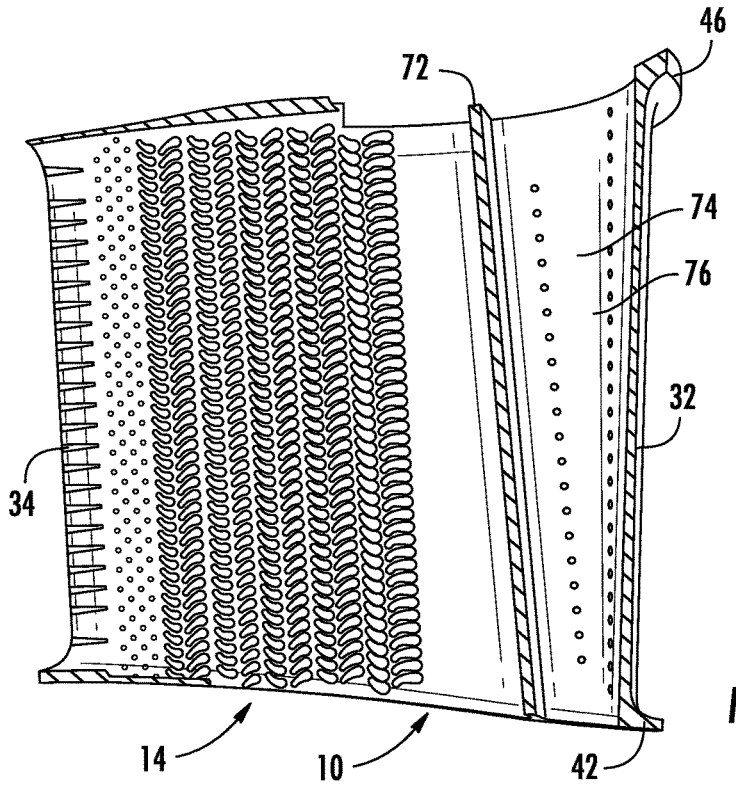
FIG. 9 is a cross-sectional view of the turbine airfoil taken along section line 9-9 in FIG. 7 and showing components of the internal cooling system protruding from an outer wall forming the suction side.
Figure 10:
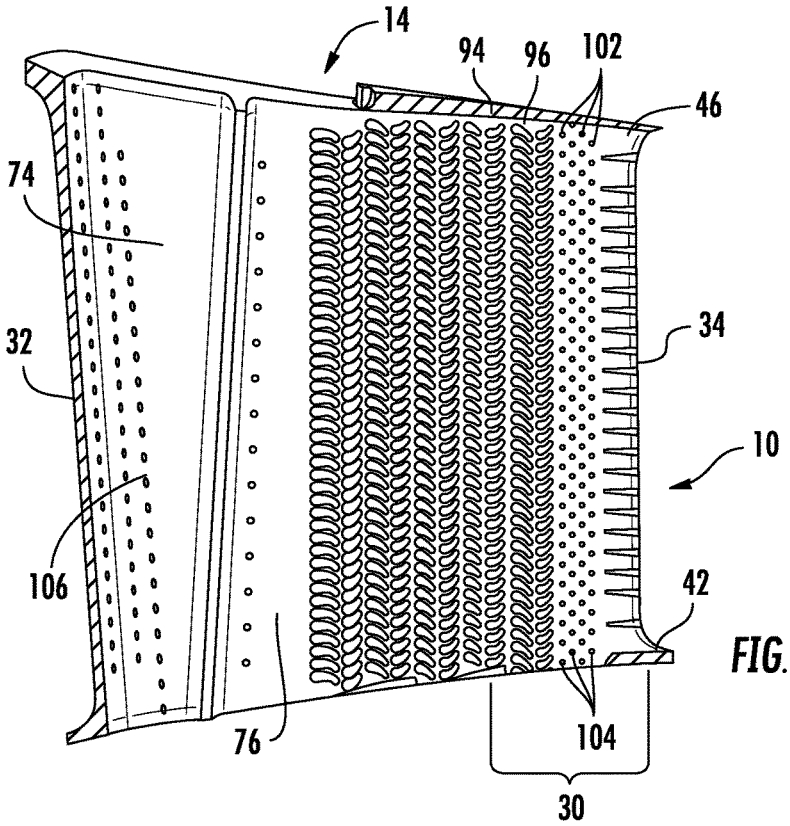
FIG. 10 is a cross-sectional view of the turbine airfoil taken along section line 10-10 in FIG. 8 and showing components of the internal cooling system protruding from an outer wall forming the pressure side.
Figure 11:
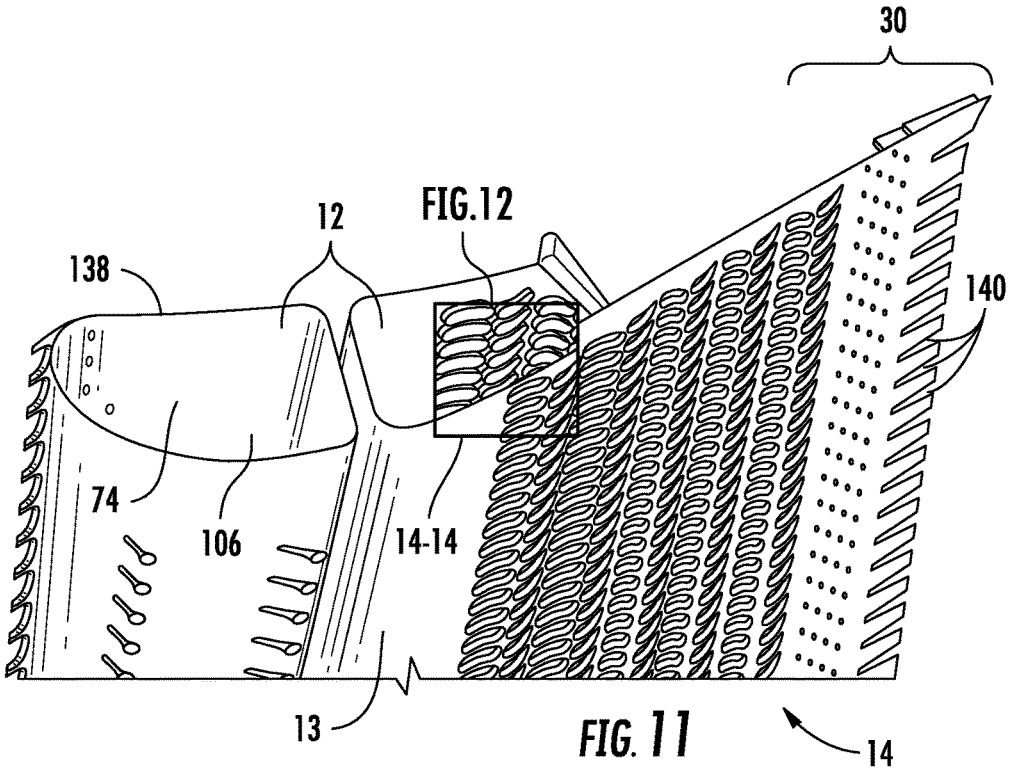
FIG. 11 is a perspective view of the inner surfaces of the outer wall forming the turbine airfoil and including components of the internal cooling system extending inwardly from the outer wall.
Figure 12:
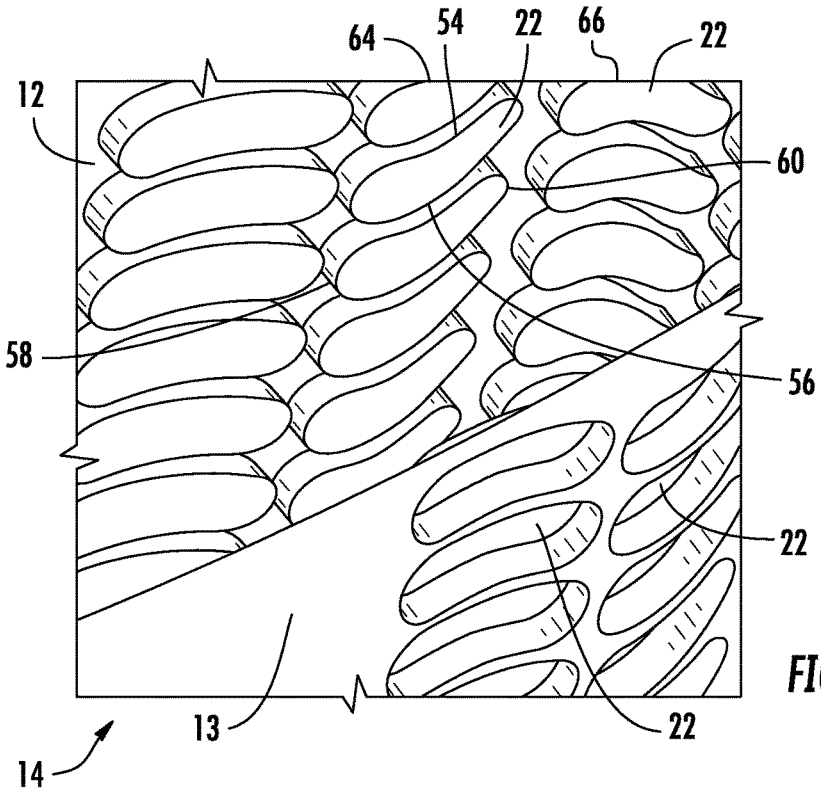
FIG. 12 is a detail perspective view of the inner surfaces of the outer wall forming the turbine airfoil and including components of the internal cooling system extending inwardly from the outer wall taken as detail 14-14, as shown in FIG. 11.

As shown in FIGS. 5 and 6, the inner surface 144 of the outer wall 12 and outer wall 13 may include one or more mini-ribs 146 protruding inwardly within the zigzag channels 52 and extending toward the trailing edge 60. The mini-ribs 146 may extend generally orthogonal to a direction of the cooling fluid flow through the zigzag channels 52. The mini-ribs 146 may have a width less than a distance between adjacent cooling fluid flow controllers 22 or may extend into contact with adjacent cooling fluid flow controllers 22. The mini-ribs 146 may also have a height less than ½ of a height of the zigzag channels 52. In another embodiment, the mini-ribs 146 may have a height less than ¼ of a height of the zigzag channels 52. In yet another embodiment, the mini-ribs 146 may have a height less than ⅛ of a height of the zigzag channels 52. The mini-ribs 146 may have a thickness in the direction of flow of the cooling fluids less than ½ of a distance between adjacent mini-ribs 146.

Figure 2:
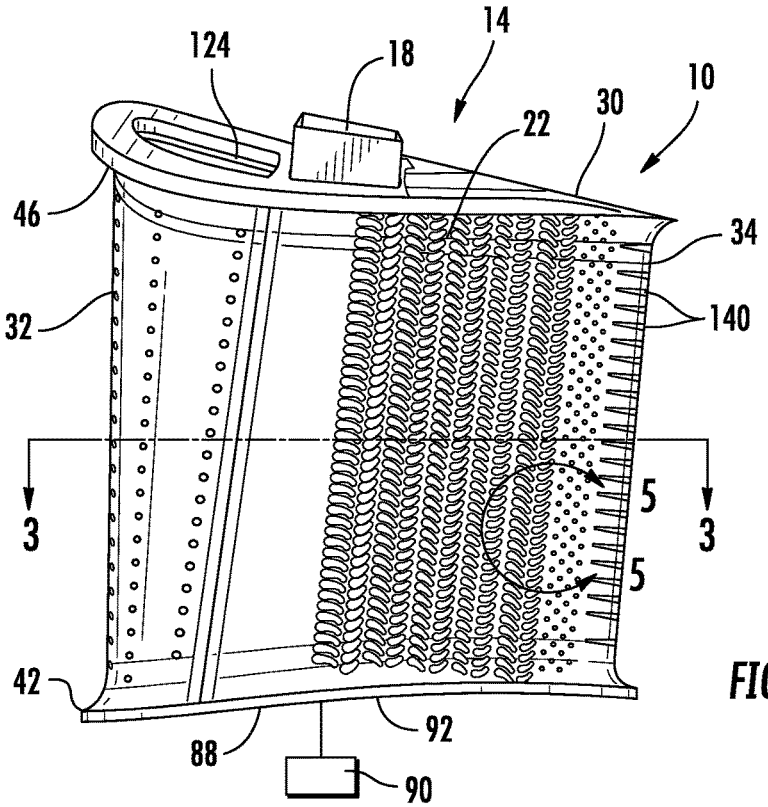
FIG. 2 is a partial perspective view of the turbine airfoil of FIG. 1.

In at least one embodiment, as shown in FIGS. 3 and 4, one of the pressure side nearwall cooling channel 48 and the suction side nearwall cooling channel 50, or both, may be in fluid communication with the trailing edge channel 30. The insert 18 may include one or more refresher holes 84 to supply the trailing edge channel 30 in addition to the pressure side nearwall cooling channel 48 and the suction side nearwall cooling channel 50 supplies to the trailing edge channel 30. The refresher holes 84 may be aligned into one or more spanwise extending rows in close proximity to an aft end 86 of the insert 18. The refresher holes 84 may have any appropriate size, length and shape to effectively exhaust cooling fluids from the insert 18 to the trailing edge channel 30. The insert 18 in the aft cooling cavity 76 may include one or more inlets 88, as shown in FIG. 2, in fluid communication with a cooling fluid supply 90 positioned in an inner diameter 92 of the generally elongated hollow airfoil 26. As such, cooling fluids are received into the insert 18 in the aft cooling cavity 76 via the inlet 88 at the inner diameter 92 and flow radially outward toward the outer endwall 44. At least a portion of the cooling fluids flow through the refresher holes 84 into the trailing edge channel 30.

The trailing edge channel 30 may include a plurality of cooling fluid flow controllers 22 extending from the outer wall 12 forming the pressure side 36 to the outer wall 13 forming the suction side 38, whereby the cooling fluid flow controllers 22 may form a plurality of alternating zigzag channels 52. The plurality of cooling fluid flow controllers 22 in the trailing edge channel 30 may be collected into a first spanwise extending row 94 of cooling fluid flow controllers 22. One or more of the cooling fluid flow controllers 22 forming the first spanwise extending row 94 within the trailing edge channel 30 may have cross-sectional areas formed by a pressure side 54 that is on an opposite side from a suction side 56, whereby the pressure and suction sides 54, 56 are coupled together via a leading edge 58 and a trailing edge 60 on an opposite end of the cooling fluid flow controller 22 from the leading edge 58. One or more of the cooling fluid flow controllers 22 within the first spanwise extending row 94 of cooling fluid flow controllers 22 may include a pressure side 54 of one cooling fluid flow controller 22 is adjacent to a suction side 56 of an adjacent cooling fluid flow controller 22. In at least one embodiment, each of the cooling fluid flow controllers 22 within the first spanwise extending row 94 of cooling fluid flow controllers 22 is positioned similarly, such that a pressure side 54 of one cooling fluid flow controller 22 is adjacent to a suction side 56 of an adjacent cooling fluid flow controller 22, except for a cooling fluid flow controller 22 at an end of the first spanwise extending row 94.

The trailing edge channel 30 may also include one or more second spanwise extending rows 96 of cooling fluid flow controllers 22 positioned downstream from the first spanwise extending row 94 of cooling fluid flow controllers 94. The second spanwise extending row 96 of cooling fluid flow controllers 22 may have one or more cooling fluid flow controllers 22 with a pressure side 54 on an opposite side of the cooling fluid flow controller 22 than in the first spanwise extending row 64 of cooling fluid flow controllers 22, thereby causing cooling fluid flowing through the second spanwise extending row 96 of cooling fluid flow controllers 22 to be directed downstream with a spanwise vector 68 that is opposite to a spanwise vector 70 imparted on the cooling fluid by the first spanwise extending row 94 of cooling fluid flow controllers 22. The trailing edge channel 30 may include a repetitive pattern of first and second spanwise extending rows 94, 96 of cooling fluid flow controllers 22 to form alternating zigzag channels 52 extending generally chordwise towards the trailing edge 34.

The trailing edge channel 30 may include one or more rows of pin fins 102 extending from the outer wall 12 forming the pressure side 36 to the outer wall 13 forming the suction side 38 and downstream from the cooling fluid flow controllers 22. The pin fins 102 may have a generally circular cross-sectional area or other appropriate shape. The pin fins 102 may be positioned in one or more spanwise extending rows 104 of pin fins 102. In at least one embodiment, the pin fins 102 may have a minimum distance between each other or between an adjacent structure other than the outer walls 12, 13 of about 1.5 millimeters.

The aft insert 18 may include one or more pressure side exhaust outlets 112 on a side of the aft insert 18 positioned closest to the outer wall 12 forming the pressure side 36 of the airfoil 26. The pressure side exhaust outlet 112 may be positioned near a forward wall 116 of the aft insert 18. The pressure side exhaust outlets 112 may be aligned into spanwise extending rows 118. In at least one embodiment, the aft insert 18 may include a plurality of pressure side exhaust outlets 112 formed into two spanwise extending rows 118 on the side of the aft insert 18 positioned closest to the outer wall 12 forming the pressure side 36 of the airfoil 26. The pressure side exhaust outlets 112 supply cooling fluids to the pressure side nearwall cooling channel 48.

The aft insert 18 may include one or more suction side exhaust outlets 120 on a side of the aft insert 18 positioned closest to the outer wall 13 forming the suction side 38 of the airfoil 26. The suction side exhaust outlet 120 may be positioned near a forward wall 116 of the aft insert 18. The suction side exhaust outlets 120 may be aligned into spanwise extending rows 118. In at least one embodiment, the aft insert 18 may include a plurality of suction side exhaust outlets 120 formed into two spanwise extending rows 118 on the side of the aft insert 18 positioned closest to the outer wall 13 forming the suction side 36 of the airfoil 26. The suction side exhaust outlets 120 supply cooling fluids to the suction side nearwall cooling channel 50.

The cooling system 14 may also include one or more bypass flow reducers 31 extending from the aft insert 18 toward the outer wall 12 forming the pressure side 36 or the outer wall 13 forming the suction side 38, or both, to reduce flow of cooling fluids through the gap 110. In at least one embodiment, as shown in FIGS. 3 and 4, the internal cooling system 14 may include a plurality of bypass flow reducers 30. One or more of the plurality of bypass flow reducers 30 may be positioned between adjacent spanwise extending rows 28 of cooling fluid flow controllers 22. The bypass flow reducer 30 may extend less than half a distance from the aft insert 18 to an inner surface 82 of the outer wall 24 forming the pressure side 36. In other embodiments, the bypass flow reducer 30 may extend more than half a distance from the aft insert 18 to the inner surface 82 of the outer wall 24 forming the pressure side 36. An aft insert 18 may have bypass flow reducers 30 with all the same height and lengths or varying heights and lengths.

The cooling system 14 may include one or more film cooling holes 136 in the outer wall 12 forming the pressure side 36. The film cooling hole 136 may exhaust cooling fluids from the pressure side nearwall cooling channel 48 near the rib 72 positioned between the forward and aft cooling cavities 74, 76. The film cooling holes 136 may be positioned in a spanwise extending row.

The forward cooling cavity 74 may include one or more forward inserts 124. The forward insert 124 may form a pressure side nearwall cooling channel 126 and a suction side nearwall cooling channel 128. The forward insert 124 may include a plurality of impingement orifices 130 extending through a pressure side 132 of the forward insert 124 and a suction side 134 of the forward insert 124. The impingement orifices 130 may have any appropriate configuration to enhance the cooling capacity of the forward insert 124 and internal cooling system 14. The leading edge 32 of the airfoil 26 may include a plurality of film cooling holes 136 that form a showerhead array of film cooling holes 136. The forward cooling cavity 74 may include an inlet 138 in connection with a fluid source that is outboard of the airfoil 26 and configured to feed cooling fluids to the inlet 138 and into the forward insert 124.

During use, cooling fluids may be supplied from a compressor or other such cooling air source to the inner chamber 106 of the forward insert 124 of the internal cooling system 14. Cooling fluids may fill the forward insert 124 and generally flow spanwise in a radially inward direction throughout the forward insert 124. Cooling fluids are passed through the impingement orifices 130 into the pressure side nearwall cooling channel 126 and through the impingement orifices 130 into the suction side nearwall cooling channel 128. The cooling fluids flowing from the impingement holes 130 impinge against the outer wall 12 forming the pressure side 36 and the outer wall 13 forming the suction side 38, thereby cooling the outer walls 12, 13. A portion of the cooling fluids from the pressure side and suction side nearwall cooling channels 126, 128 are exhausted from the internal cooling system 14 via the plurality of film cooling holes 136 forming the showerhead and the other film cooling holes. The cooling fluids may also form film cooling on an outer surface of the outer walls 12, 13 via the film cooling holes 136 at the leading edge 32 that are configured to form a showerhead and the other film cooling holes in the outer walls 12, 13 forming the pressure and suction sides 36, 38.

Cooling fluids may be supplied to the aft insert 18 via the inlet 88. The cooling fluids may be supplied from a channel in communication with the forward insert 124 or from another source. Cooling fluids may fill the aft insert 18 and may generally flow spanwise throughout the aft insert 18. Cooling fluids are passed through the pressure side exhaust outlets 112 and into the pressure side nearwall cooling channel 48 and are passed through the suction side exhaust outlets 114 and into the suction side nearwall cooling channel 50. The cooling fluids flowing through the pressure side exhaust outlets 112 and into the pressure side nearwall cooling channel 48 impinge upon the outer wall 12 forming the pressure side 36. A portion of the cooling fluids may be exhausted through the film cooling orifices at an upstream end of the pressure side nearwall cooling channel 48 near the rib 72 form the upstream end of the pressure side nearwall cooling channel 48. The cooling fluids flowing through the suction side exhaust outlets 114 and into the suction side nearwall cooling channel 50 impinge upon the outer wall 13 forming the suction side 38.

The cooling fluids in the pressure side nearwall cooling channel 48 on the pressure side 36 are directed toward an inner surface of the outer wall 12 forming the pressure side 36 by a first bypass flow reducer 31 where the cooling fluids flow through a first row of cooling fluid flow controllers 22 rather than flowing in between the small gap 110 between an end 111 of the cooling fluid flow controllers 22 and the aft insert 18. The bypass flow reducers 31 direct the cooling fluids towards the outer wall 12 forming the pressure side 36, thereby substantially reducing the flow of cooling fluids between the gap 110 created between the end 111 of the cooling fluid flow controllers 22 and the aft insert 18. The gap 110 may be about 0.3 millimeters in size due to assembly. Tighter tolerances on either side would aide flow and H/T characteristics, while increased clearances would negatively affect flow and H/T. In addition, the bypass flow reducers 31 may direct the cooling fluids towards the outer wall 12 forming the pressure side 36, which is most need of cooling due to its direct exposure to the combustor exhaust gases. The cooling fluids flow through successive rows of cooling fluid flow controllers 22 zigzagging back and forth and increasing in temperature moving toward the trailing edge 34 as the cooling fluids pick up heat from the outer wall 12 and the cooling fluid flow controllers 22. The cooling fluids entering the suction side nearwall cooling channel 50 may flow substantially in the same manner as the fluids in the pressure side nearwall cooling channel 48 described above, and thus, for brevity, are not further reiterated here.

The cooling fluids from the pressure side nearwall cooling channel 48 and the suction side nearwall cooling channel 50 may be exhausted into the trailing edge channel 30. In addition, cooling fluids from within the aft insert 18 may be exhausted directly into the trailing edge channel 30 via the refresher holes 84. As the cooling fluids enter the trailing edge channel 30, the cooling fluids pass through the first and second spanwise extending rows 94, 96, whereby the cooling fluids strike the cooling fluid flow controllers 22 and increase in temperature. The first and second spanwise extending rows 94, 96 of fluid flow controllers 22 also impart a zigzag motion to the cooling fluids. The cooling fluids may also flow past one or more rows of pin fins 102 and may be exhausted from the trailing edge exhaust orifices 140.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil for a gas turbine engine, comprising:

a generally elongated hollow airfoil formed from an outer wall and having a leading edge, a trailing edge, a pressure side, a suction side, and inner endwall at a first end and an outer endwall at a second end that is generally on an opposite side of the generally elongated hollow airfoil from the first end and a cooling system positioned within interior aspects of the generally elongated hollow airfoil;

the cooling system includes at least one aft cooling cavity in which an insert is positioned that forms a pressure side nearwall cooling channel and a suction side nearwall cooling channel;

wherein a plurality of cooling fluid flow controllers extend from the outer wall forming the generally elongated hollow airfoil toward the insert, where the cooling fluid flow controllers form a plurality of alternating zigzag channels extending downstream toward the trailing edge; and at least one bypass flow reducer extending from the insert toward the outer wall to reduce bypass flow of cooling fluids.

2. The turbine airfoil of claim 1, wherein at least one of the cooling fluid flow controllers has a cross-sectional area formed by a pressure side that is on an opposite side from a suction side, whereby the pressure and suction sides are coupled together via a leading edge and trailing edge on an opposite end of the at least one cooling fluid flow controller from the leading edge and wherein the pressure side has a generally concave curved surface and the suction side has a generally convex curved surface.

3. The turbine airfoil of claim 2, wherein the plurality of cooling fluid flow controllers are collected into a first spanwise extending row of cooling fluid flow controllers, wherein each of the cooling fluid flow controllers within the first spanwise extending row of cooling fluid flow controllers is positioned similarly, such that a pressure side of one cooling fluid flow controller is adjacent to a suction side of an adjacent cooling fluid flow controller, except for a cooling fluid flow controller at an end of the first spanwise extending row.

4. The turbine airfoil of claim 3, further wherein a second spanwise extending row of cooling fluid flow controllers positioned downstream from the first spanwise extending row of cooling fluid flow controllers.

5. The turbine airfoil of claim 4, wherein the second spanwise extending row of cooling fluid flow controllers has at least one cooling fluid flow controller with a pressure side on an opposite side of the cooling fluid flow controller than in the first spanwise extending row of cooling fluid flow controllers, thereby causing cooling fluid flowing through the second spanwise extending row of cooling fluid flow controllers to be directed downstream with a spanwise vector that is opposite to a spanwise vector imparted on the cooling fluid by the first spanwise extending row of cooling fluid flow controllers.

6. The turbine airfoil of claim 5, wherein each of the cooling fluid flow controllers forming the second spanwise extending row of cooling fluid flow controllers has at least one cooling fluid flow controller with a pressure side on an opposite side of the cooling fluid flow controller than in the first spanwise extending row of cooling fluid flow controllers.

7. The turbine airfoil of claim 1, wherein the plurality of cooling fluid flow controllers extend from the outer wall forming the pressure side of the generally elongated hollow airfoil, and wherein the plurality of cooling fluid flow controllers extend from the outer wall forming the suction side of the generally elongated hollow airfoil.

8. The turbine airfoil of claim 1, wherein both the pressure side nearwall cooling channel and the suction side nearwall cooling channel are in fluid communication with a trailing edge channel.

9. The turbine airfoil of claim 8, wherein the trailing edge channel includes a plurality of cooling fluid flow controllers extending from the outer wall forming the pressure side to the outer wall forming the suction side, wherein the cooling fluid flow controllers form a plurality of alternating zigzag channels.

10. The turbine airfoil of claim 9, wherein the plurality of cooling fluid flow controllers are collected into a first spanwise extending row of cooling fluid flow controllers, wherein each of the cooling fluid flow controllers within the first spanwise extending row of cooling fluid flow controllers is positioned similarly, such that a pressure side of one cooling fluid flow controller is adjacent to a suction side of an adjacent cooling fluid flow controller, except for a cooling fluid flow controller at an end of the first spanwise extending row, and further comprising a second spanwise extending row of cooling fluid flow controllers positioned downstream from the first spanwise extending row of cooling fluid flow controllers, wherein the second spanwise extending row of cooling fluid flow controllers has at least one cooling fluid flow controller with a pressure side on an opposite side of the cooling fluid flow controller than in the first spanwise extending row of cooling fluid flow controllers, thereby causing cooling fluid flowing through the second spanwise extending row of cooling fluid flow controllers to be directed downstream with a spanwise vector that is opposite to a spanwise vector imparted on the cooling fluid by the first spanwise extending row of cooling fluid flow controllers.

11. The turbine airfoil of claim 8, wherein the insert includes at least one refresher hole to supply the trailing edge channel in addition to the pressure side nearwall cooling channel and the suction side nearwall cooling channel.

12. The turbine airfoil of claim 1, wherein the insert in the at least one aft cooling cavity includes at least one inlet in fluid communication with a cooling fluid supply positioned in an inner diameter of the generally elongated hollow airfoil.

* * * * *